US007827793B2

(12) United States Patent
Onaka et al.

(10) Patent No.: US 7,827,793 B2
(45) Date of Patent: Nov. 9, 2010

(54) POWER GENERATION SYSTEM

(75) Inventors: Ikuo Onaka, Chiba-ken (JP); Yoshiaki Kouno, Chiba-ken (JP); Toshiki Matsuoka, Nagasaki-ken (JP); Taishi Muraki, Nagasaki-ken (JP)

(73) Assignees: The Tokyo Electric Power Company, Incorporated, Tokyo (JP); Mitsubishi Heavy Industries, Ltd., Tokyo (JP)

( * ) Notice: Subject to any disclaimer, the term of this patent is extended or adjusted under 35 U.S.C. 154(b) by 326 days.

(21) Appl. No.: 11/984,466

(22) Filed: Nov. 19, 2007

(65) Prior Publication Data

US 2008/0236139 A1 Oct. 2, 2008

(30) Foreign Application Priority Data

Mar. 30, 2007 (JP) ..... 2007-091784

(51) Int. Cl.
*F01K 7/34* (2006.01)

(52) U.S. Cl. ..... 60/653; 60/660

(58) Field of Classification Search ..... 60/653, 60/677–680, 660
See application file for complete search history.

(56) References Cited

U.S. PATENT DOCUMENTS 4,068,475 A * 1/1978 Binstock ..... 60/646
4,241,585 A * 12/1980 Gorzegno ..... 60/646
4,287,430 A * 9/1981 Guido ..... 290/40 C
4,290,389 A * 9/1981 Palchik ..... 122/406.4

FOREIGN PATENT DOCUMENTS

JP 7-224610 A 8/1995
JP 9-96227 A 4/1997
JP 2000-111003 A 4/2000

* cited by examiner

*Primary Examiner*—Hoang M Nguyen
(74) *Attorney, Agent, or Firm*—Westerman, Hattori, Daniels & Adrian, LLP

(57) ABSTRACT

To provide a power generation system that prevents a reduction in the efficiency of a steam turbine due to an aperture adjustment of a turbine governing valve. There is provided a power generation system comprising: a furnace in which a solid fuel or a liquid fuel is combusted; a steam turbine that generates electric power by rotating a turbine rotor using steam generated by the furnace; a superheater that is provided between the furnace and the steam turbine and that superheats the steam; a first steam piping that connects the furnace to the superheater; a second steam piping that connects the superheater to the steam turbine; a first valve provided in the first steam piping; a turbine governing valve provided in the second steam piping; and a control section that adjusts an aperture of the first valve according to a load of the steam turbine.

9 Claims, 4 Drawing Sheets

POWER GENERATION SYSTEM

BACKGROUND OF THE INVENTION

1. Field of the Invention

The present invention relates to a power generation system having a constant pressure once-through boiler.

This application is based on Japanese Patent Application No. 2007-091784, the content of which is incorporated herein by reference.

2. Description of Related Art

In thermal electric power plants, power generation systems that have a constant pressure once-through boiler and a steam turbine as the main constituents are often employed (See for example, Japanese Unexamined Patent Application, Publication No. Hei 9-96227). Such power generation systems generate electric power by means of a steam turbine using steam generated by a constant pressure once-through boiler.

FIG. 3 shows an example of a conventional power generation system.

First, the steam for driving a steam turbine 34 is generated by a furnace 32. The steam generated by the furnace 32 flows through a first steam piping 31 provided with a boiler throttle valve 35, or a first steam throttle bypass piping 36 provided with a boiler throttle bypass valve 30, and is guided to a first superheater 37*a*. The steam that has been superheated by the first superheater 37*a* flows through a desuperheater 39 and is guided to a second superheater 37*b*. The steam that has been superheated again by the second superheater 37*b* flows through a second steam piping 33 and is then guided to the steam turbine 34. At this time, a turbine governing valve 38 provided in the second steam piping 33 adjusts a flow amount of the steam according to the load of the steam turbine 34.

In the conventional power generation system, after the pressure of a fluid (water vapor) is raised to a supercritical pressure at the furnace 32, this pressure is maintained up to the entry of the turbine governing valve 38, and the aperture of the turbine governing valve 38 is adjusted according to the load of the steam turbine 34.

Here, the electric power generated by the steam turbine 34 is known to be approximately proportional to the product of the pressure of the steam flowing in, and the aperture of the turbine governing valve 38. As described above, since the steam pressure in the second steam piping 33 is constant (supercritical pressure) up to the inlet of the turbine governing valve 38, in the case where the electric power required to be generated by the steam turbine 34 is low, the aperture of the turbine governing valve 38 needs to be significantly narrowed. As a result, there has been a problem in that the efficiency of the steam turbine 34 is reduced due to a loss in steam pressure at the turbine governing valve 38.

Moreover, if the throttle ratio at the turbine governing valve 38 becomes greater, the steam temperature drop at the inlet of steam turbine 34 also becomes greater due to a significant influence of adiabatic expansion. However, since the fluctuation ratio of the steam turbine 34 inlet temperature that can be handled by the steam turbine 34 is limited, also the fluctuation ratio of the aperture of the turbine governing valve 38 naturally becomes limited. As a result, there has been a problem in that the steam turbine 34 cannot be operated so as to comply with the required electric power.

BRIEF SUMMARY OF THE INVENTION

The present invention has been achieved to solve the above problems, and its object is to provide a power generation system that prevents a reduction in the efficiency of a steam turbine due to adjustment of the aperture of the turbine governing valve.

In order to solve the above problems, the present invention employs the following means.

A power generation system according to one aspect of the present invention comprises: a furnace in which a solid fuel or a liquid fuel is combusted; a steam turbine that generates electric power by rotating a turbine rotor using steam generated by the furnace; a superheater that is provided between the furnace and the steam turbine and that superheats the steam; a first steam piping that connects the furnace to the superheater; a second steam piping that connects the superheater to the steam turbine; a first valve provided in the first steam piping; one set of the turbine governing valve provided in the second steam piping; and a control section that adjusts an aperture of the first valve according to a load of the steam turbine.

According to the power generation system having such an aspect, since the pressure of the steam is adjusted on the upstream side of the superheater to a value according to the load of the steam turbine, an operation range of the turbine governing valve disposed on the downstream side of the superheater can be reduced. Accordingly, when operating the turbine governing valve, a reduction in the turbine inlet steam temperature due to the adiabatic expansion can be prevented. As a result, the efficiency of the steam turbine can be improved.

Moreover, by reducing the operation range of the turbine governing valve, a steam temperature fluctuation at the steam turbine inlet can be reduced. As a result, the lifetime of the steam turbine can be extended. Furthermore, the operation range of the turbine governing valve is no longer limited, so that a flow amount of the steam that flows into the steam turbine can be freely adjusted. As a result, compliance of the steam turbine with respect to a required electric power can be improved.

The power generation system may also be configured such that; a third steam piping that bypasses the first valve is connected to the first steam piping, and a second valve is provided in the third steam piping, and the apertures of the first valve and the second valve are adjusted according to the load of the steam turbine.

According to the power generation system having such a configuration, an amount of steam supply to the steam turbine can be finely adjusted.

The power generation system may also be configured such that the control section: adjusts the second valve according to the load of the steam turbine, in a case where the load of the steam turbine is no more than a first threshold value; adjusts the apertures of the first valve and the second valve according to the load of the steam turbine, in a case where the load of the steam turbine is no less than the first threshold value and no more than a second threshold value; and adjusts the aperture of the second valve according to the load of the steam turbine with the first valve fully opened, in a case where the load of the steam turbine is no less than the second threshold value.

According to the power generation system having such a configuration, the steam pressure at the entry section of the turbine governing valve can be gradually varied. As a result, control of the pressure of the steam flowing into the steam turbine can be carried out easily.

Furthermore, by adjusting the aperture of the second valve, with an aperture that gives the allowable differential pressure of the first valve taken as an upper limit, the efficiency of the steam turbine can be improved without renewing existing equipment such as the first valve. As a result, the cost accompanying equipment renewal can be suppressed.

According to the power generation system according to the present invention, the efficiency of the steam turbine can be improved.

DETAILED DESCRIPTION OF THE INVENTION

Hereunder, an embodiment of a power generation system according to the present invention is described, with reference to drawings.

Figure 1:
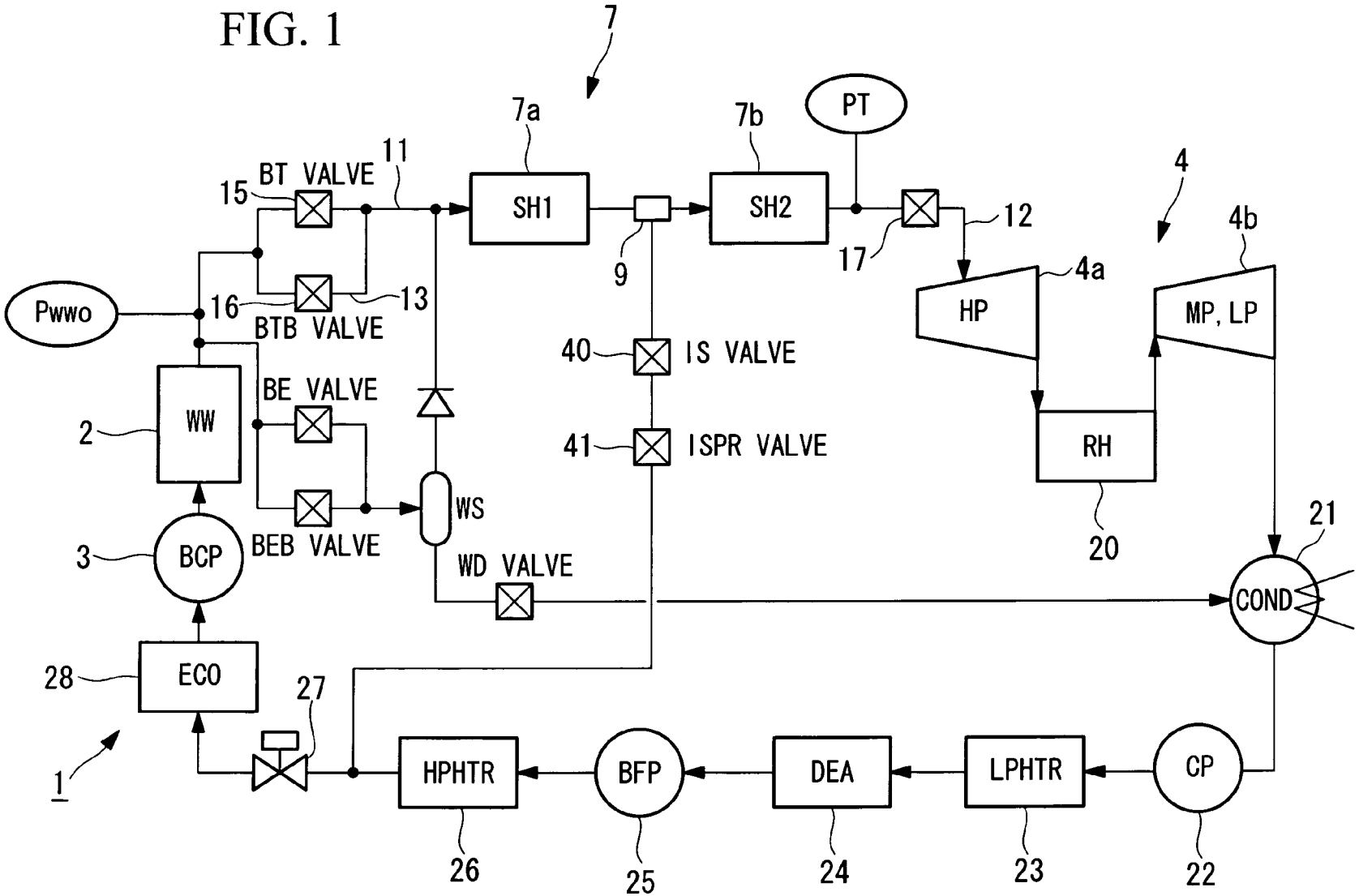
FIG. 1 is a schematic diagram schematically showing a configuration of a power generation system according to an embodiment of the present invention.

In FIG. 1, the main constituents of a power generation system 1 include: a furnace 2 for combusting a solid fuel or a liquid fuel; a boiler circulation pump 3 that causes water to flow through a water pipe (not shown in the drawing) provided within the furnace 2; a steam turbine 4 that generates electric power by rotating a turbine rotor using steam generated in the furnace 2; a superheater 7 that is provided between the furnace 2 and the steam turbine 4 and that superheats steam; a first steam piping 11 that connects the furnace 2 to the superheater 7; a second steam piping 12 that connects the superheater 7 to the steam turbine 4; a first valve 15 provided in the first steam piping 11; a turbine governing valve 17 provided in the second steam piping 12; a third steam piping 13 that is connected to the first steam piping 11 and bypasses the first valve 15; a second valve 16 provided in the third steam piping 13; and a control section (not shown in the drawing) that adjusts the apertures of the first valve 15 and the second valve 16 according to the load of the steam turbine 4.

In the present embodiment, the steam turbine 4 is provided with a high pressure steam turbine 4*a* and a middle/low pressure steam turbine 4*b*, and the steam discharged from the high pressure steam turbine 4*a* is supplied to the low/middle pressure steam turbine 4*b* via a reheater 20.

The superheater 7 is provided with a first superheater 7*a* provided on the upstream side and a second superheater 7*b* provided on the downstream side, and there is provided a desuperheater 9 that reduces the temperature of the steam flowing between the first superheater 7*a* and the second superheater 7*b*.

Hereunder, a superheating cycle of water in the power generation system having the above configuration is described.

In the furnace 2, a solid fuel or a liquid fuel is combusted and the boiler circulation pump 3 is started to circulate water through the water pipe provided within the furnace 2, and steam is thereby generated. The steam generated in the furnace 2 flows through the first steam piping 11 so as to be guided to the first superheater 7*a*. The steam is superheated in the first superheater 7*a*, and the steam superheated by the first superheater 7*a* is guided to the desuperheater 9. The desuperheater 9 reduces the temperature of the steam by injecting water. The steam desuperheated by the desuperheater 9 is guided to the second superheater 7*b*, and is then superheated again by the second superheater 7*b*. The steam that has been superheated again by the second superheater 7*b* flows through the second steam piping 12 and is guided to the high pressure steam turbine 4*a* so as to be used for driving the high pressure steam turbine 4*a*.

The steam that has driven the high pressure steam turbine 4*a* is guided to the reheater 20 and is superheated again by the reheater 20. The steam that has been superheated again by the reheater 20 is guided to the middle/low pressure steam turbine 4*b* so as to be used for driving the middle/low pressure steam turbine 4*b*.

The steam that has driven the middle/low pressure steam turbine 4*b* is guided to a condenser 21 and is returned into water (into a liquid state) by the condenser 21. The water generated by the condenser 21 is pressure-fed to a low pressure feed water heater 23 and a deaerator 24 in this order by a condensate pump 22. The water that has been deaerated by the deaerator 24 is pressure-fed by a boiler feed water pump 25 to a high pressure feed water heater 26, and is pressure-fed to the desuperheater 9 or an economizer 28. The water pressure-fed to the desuperheater 9 is used for reducing the temperature of the steam. The water that has been pressure-fed to the economizer 28 is guided to the furnace 2 by the boiler circulation pump 3 so as to be used as steam again.

Next, for the power generation system having the above cycle, detailed operations and effects of the first valve 15, the second valve 16, and the turbine governing valve 17 according to the present embodiment are described.

Figure 2:
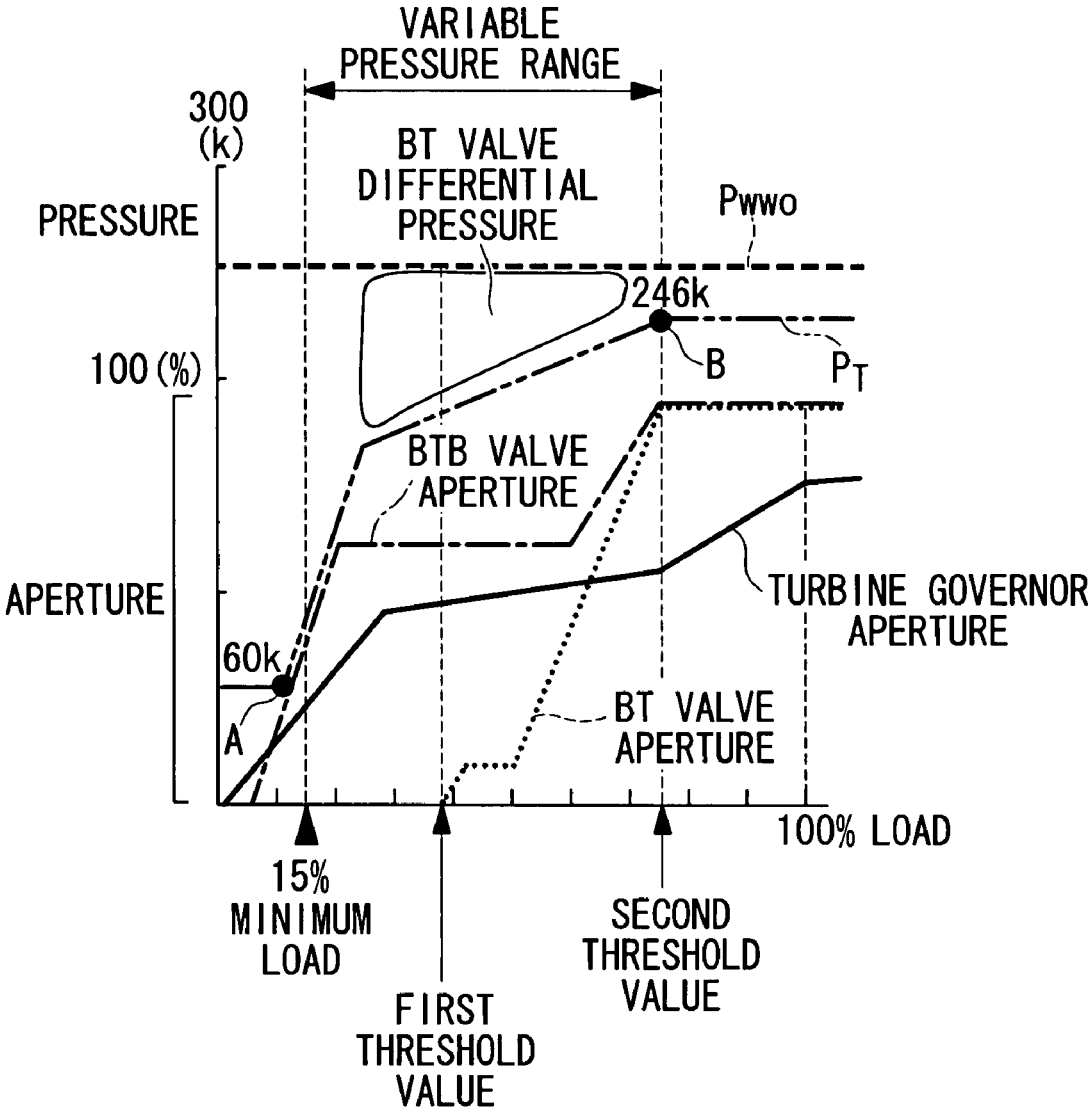
FIG. 2 is a graph showing a relationship between the apertures of various types of valves, and the load of a steam turbine, and the steam pressure, in a power generation system according to the present embodiment.
Figure 3:
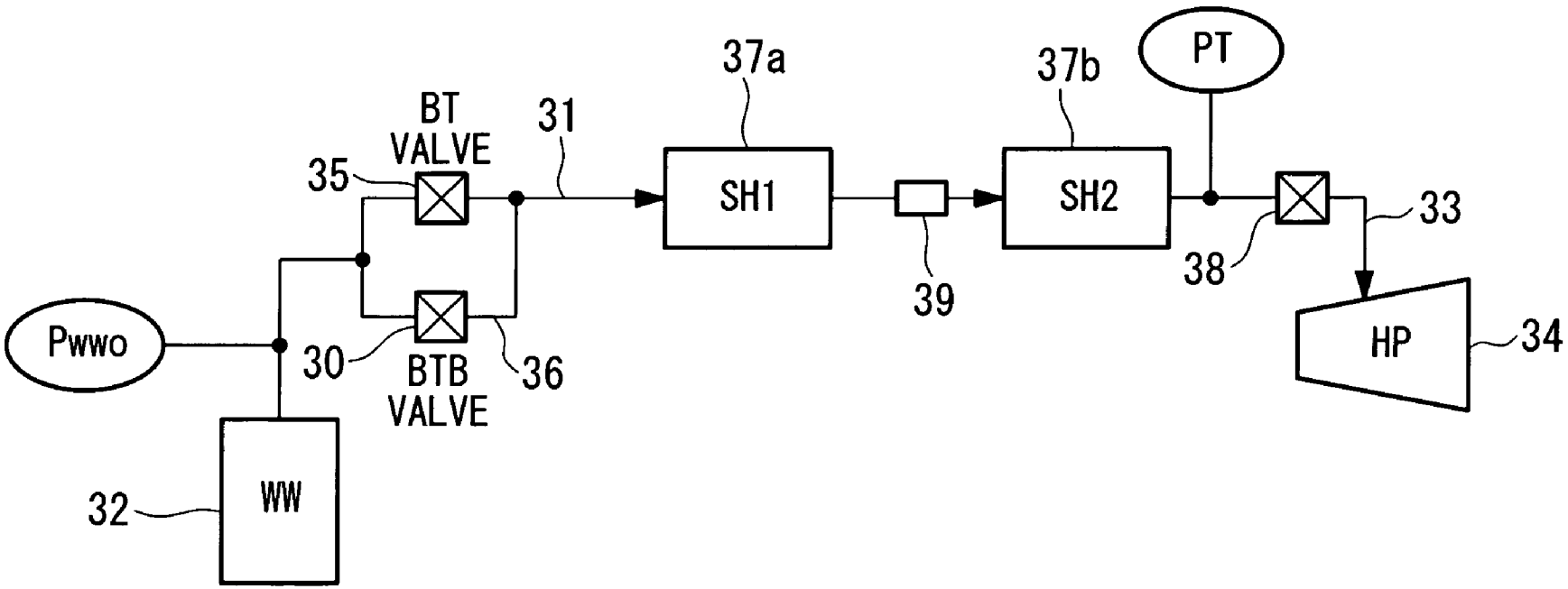
FIG. 3 is a schematic diagram schematically showing a configuration of a conventional power generation system.

FIG. 2 shows a relationship between the apertures of the first valve 15, the second valve 16, and the turbine governing valve 17, and the load of the steam turbine 4, and the steam pressure, when the power generation system according to the present embodiment is started.

In this graph, the horizontal axis represents the loads of the high pressure steam turbine 4*a* and the middle/low pressure steam turbine 4*b*, more specifically it shows the ratios of the loads with respect to a nominal load, and the vertical axis represents the apertures of the various types of valves, or the steam pressure. Furthermore, in this graph, BT valve aperture represents an aperture of the first valve 15, BTB valve aperture represents an aperture of the second valve 16, $P_T$ represents steam pressure at the entry section of the turbine governing valve 17, and $P_{WWO}$ represents steam pressure at the exit section of the furnace 2.

First, when the power generation system is started, the second valve 16 is opened to cause the steam generated in the furnace 2 to flow through the third steam piping 13. At this time, the second valve 16 is not fully opened but is opened at an aperture where the steam pressure PT at the entry section of the turbine governing valve 17 does not rapidly rise (for example, 50%). At this time, the aperture of the second valve 16 is adjusted so that a differential pressure between the steam pressure $P_{WWO}$ at the exit section of the furnace 2 and the steam pressure $P_T$ at the entry section of the turbine governing valve 17 does not exceed an allowable differential pressure of the first valve 15.

Next, in the case where the load ratio with respect to the nominal load reaches or exceeds a first threshold value (for example, 40%), the steam pressure $P_T$ is controlled with the second valve 16 so as not to fluctuate, while the first valve 15 is opened to a certain aperture (for example, 10%), and the steam generated in the furnace 2 flows through the first steam piping 11.

Subsequently, the apertures of the first valve 15 and the second valve 16 are adjusted according to the load, while the load ratio with respect to the nominal load does not exceed a second threshold value (for example, 75%). At this time, the apertures of the first valve 15 and the second valve 16 are adjusted so that the steam pressure $P_T$ at the entry section of the turbine governor 17 gradually reaches a maximum pressure (for example, 24 MPa) determined by the specification of the furnace 2, and so that the differential pressure of before and after the first valve 15 does not exceed an allowable differential pressure.

As described above, by adjusting the apertures of the second valve 16 and the first valve 15, the steam pressure in the turbine governing valve 17 can be adjusted to a pressure according to the turbine load. As a result, an amount of adjustment of the steam flow by the turbine governing valve 17 can be reduced. That is to say, as shown in FIG. 2, the aperture of the turbine governing valve 17 with respect to a load fluctuation of the steam turbine 4 can be gradually changed.

Figure 4:
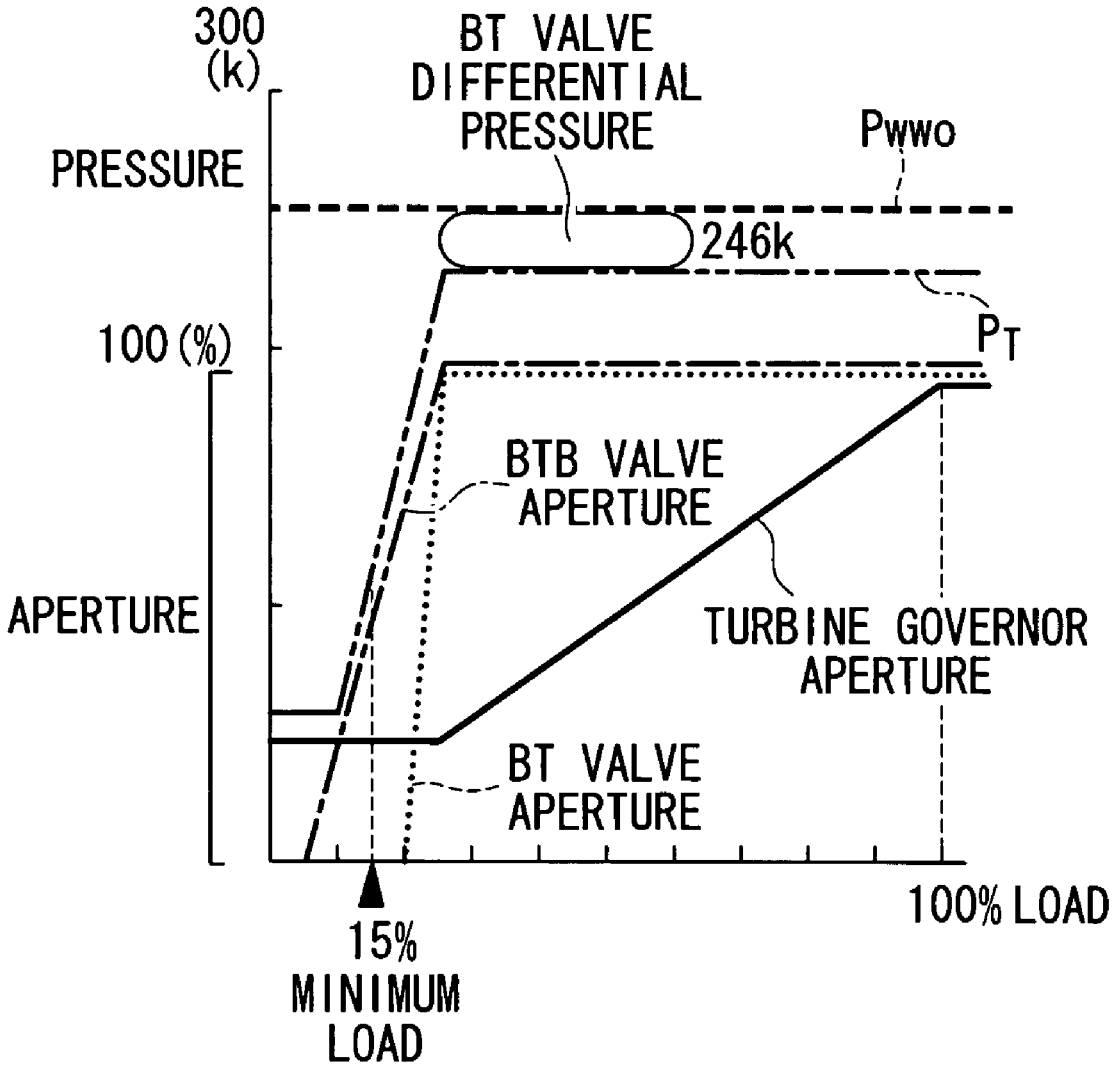
FIG. 4 is a graph showing a relationship between the apertures of various types of valves, and the load of a steam turbine, and the steam pressure, in a conventional power generation system.

Here, FIG. 4 shows a relationship between the apertures of a boiler throttle bypass valve, a boiler throttle valve, and a turbine governing valve, and the load of the steam turbine 4, and the steam pressure, in a conventional power generation system.

As shown in FIG. 4, in the conventional power generation system, a boiler throttle bypass valve 16 is opened first, and then a boiler throttle valve 15 is opened when a load required for starting the entire power generation system 1 (for example 15%) is achieved. At this time, the boiler throttle bypass valve 16 and the boiler throttle valve 15 are fully opened. In response to the above operation, the steam pressure $P_T$ at the entry of the turbine governing valve 17 rapidly rises to the maximum pressure (for example, 24 MPa), and then it maintains the, above maximum steam pressure regardless of the load of the steam turbine 4. Therefore, in the conventional power generation system, a fluctuation in the load of the steam turbine 4 needs to be addressed only by adjusting the aperture of the turbine governing valve. As a result, a fluctuation ratio of the aperture of the turbine governing valve 17 is greater than the fluctuation ratio according to the present embodiment shown in FIG. 2.

As described above, according to the power generation system of the present embodiment, since the steam pressure is adjusted on the upstream side of the turbine governing valve 17, to a pressure according to the load of the steam turbine 4, the operation range of the turbine governing valve 17 can be made small. Accordingly, a pressure loss that occurs at the turbine governing valve 17 when the turbine governing valve 17 is operated can be reduced. As a result, the efficiency of the steam turbine 4 can be improved. The steam temperature at outlet of first valve 15 decreases due to the occurrence of adiabatic expansion due to the operation of the first valve 15. However, it will not become a problem because this steam is superheated by the first superheater 7*a* and the second superheater 7*b* disposed on the downstream side of the first valve 15.

Moreover, by reducing the operation range of the turbine governing valve 17, a temperature fluctuation in the steam that flows into the high pressure steam turbine 4*a* can be reduced. As a result, the lifetime of the high pressure steam turbine 4*a* can be extended. Furthermore, limitations on the operation range of the turbine governing valve 17 are reduced so that a flow amount of the steam that flows into the high pressure steam turbine 4*a* can be freely adjusted. As a result, compliance of the steam turbine 4 with a required electric power generation amount can be improved.

Since the apertures of the first valve 15 and the second valve 16 are adjusted as described above, the steam pressure $P_T$ at the entry section of the turbine governing valve 17 can be gradually varied, and the pressure of the steam that flows into the high pressure steam turbine 4*a* can be easily controlled.

Moreover, by adjusting the aperture of the second valve 16, with an aperture that gives the allowable differential pressure of the first valve 15 taken as an upper limit, a reduction in the efficiency of the steam turbine 4 can be prevented without renewing existing equipment such as the first valve. As a result, the cost accompanying equipment renewal can be suppressed.

In the desuperheater 9 temperature control of the steam is carried out by injecting water into the steam. Therefore, the pressure of the feed water needs to be raised above the steam pressure in order to inject water. That is to say, in the conventional power generation system, the pressure of the water that is supplied into the desuperheater 9 needs to be maintained above the pressure of the steam by opening and closing a variable nozzle 27. On the other hand, according to the power generation system of the present embodiment, it is possible to have the pressure in the desuperheater 9 lower than that in the conventional power generation system. Therefore, the pressure of feed water can be easily retained above the pressure of steam, and it becomes possible to simplify the temperature control of the steam.

In the present embodiment, the case where the load of the steam turbine 4 rises has been described. However, also in cases where the load of the steam turbine 4 falls or fluctuates, the same effects can be achieved by adjusting the apertures of the first valve 15 and the second valve 16 as described above.

The aperture control for the first valve 15 and the second valve 16 according to the present embodiment shown in FIG. 2 is an example, and it is not limited to this example. For example, in the case where the load fluctuates from a minimum load (for example, 15%) to the nominal load (100%), it is preferable that the steam pressure $P_T$ is controlled so as to fluctuate, in proportion to the fluctuation of the load, from the minimum pressure to the maximum pressure. In other words, in FIG. 2, it is preferable that the steam pressure $P_T$ fluctuates so as to form a straight line (not shown in the graph) from the point A to the point B. Therefore, in the present invention, it is preferable that the apertures of the first valve 15 and the second valve 16 are adjusted so that the steam pressure $P_T$ draws a substantially straight line as mentioned above.

What is claimed is:

1. A power generation system comprising:

a furnace for combusting a solid fuel or a liquid fuel;

a steam turbine that generates electric power by rotating a turbine rotor using steam generated by said furnace;

a superheater that is provided between said furnace and said steam turbine and that superheats steam;

a first steam piping that connects said furnace to said superheater;

a second steam piping that connects said superheater to said steam turbine;

a first valve provided in said first steam piping;

a turbine governing valve provided in said second steam piping; and a control section that adjusts an aperture of said first valve according to a load of said steam turbine.

2. A power generation system according to claim 1, wherein a third steam piping that bypasses said first valve is connected to said first steam piping, and a second valve is provided in said third steam piping, and the apertures of said first valve and said second valve are adjusted according to the load of said steam turbine.

3. A power generation system according to claim 2, wherein said control section:

adjusts said second valve according to the load of said steam turbine, in a case where the load of said steam turbine is no more than a first threshold value;

adjusts the apertures of said first valve and said second valve according to the load of said steam turbine, in a case where the load of said steam turbine is no less than the first threshold value and no more than a second threshold value; and adjusts the aperture of said second valve according to the load of said steam turbine with said first valve fully opened, in a case where the load of said steam turbine is no less than the second threshold value.

4. A power generation system, comprising:

a furnace;

a superheater;

a first steam piping that connects the furnace to the superheater;

a first valve provided in the first steam piping, the first valve adjusting a flow amount of a steam generated by the furnace, the steam generated by the furnace being guided to the superheater;

a steam turbine;

a control section that adjusts an aperture of the first valve according to a load of the steam turbine;

a second steam piping that connects the superheater to the steam turbine; and a turbine governing valve provided in the second steam piping, the turbine governing valve adjusting a flow amount of the steam superheated in the superheater, the steam superheated in the superheater being guided to the steam turbine and used for driving the steam turbine, wherein the steam pressure on an upstream side of the turbine governing valve is adjusted to a pressure according to a load of the steam turbine.

5. A power generation system according to claim 4, wherein a third steam piping that bypasses said first valve is connected to said first steam piping, and a second valve is provided in said third steam piping, and the apertures of said first valve and said second valve are adjusted according to the load of said steam turbine.

6. A power generation system according to claim 5, wherein said control section:

adjusts said second valve according to the load of said steam turbine, in a case where the load of said steam turbine is no more than a first threshold value;

adjusts the apertures of said first valve and said second valve according to the load of said steam turbine, in a case where the load of said steam turbine is no less than the first threshold value and no more than a second threshold value; and adjusts the aperture of said second valve according to the load of said steam turbine with said first valve fully opened, in a case where the load of said steam turbine is no less than the second threshold value.

7. A power generation system comprising:

a steam turbine that generates electric power by rotating;

a turbine rotor using steam generated by a furnace;

a superheater that is provided between said furnace and said steam turbine and that superheats steam;

a first steam piping that connects said furnace to said superheater;

a second steam piping that connects said superheater to said steam turbine;

a first valve provided in said first steam piping;

a turbine governing valve provided in said second steam piping; and a control section that adjusts an aperture of said first valve according to a load of said steam turbine.

8. A power generation system according to claim 7, wherein a third steam piping that bypasses said first valve is connected to said first steam piping, and a second valve is provided in said third steam piping, and the apertures of said first valve and said second valve are adjusted according to the load of said steam turbine.

9. A power generation system according to claim 8, wherein said control section:

adjusts said second valve according to the load of said steam turbine, in a case where the load of said steam turbine is no more than a first threshold value;

adjusts the apertures of said first valve and said second valve according to the load of said steam turbine, in a case where the load of said steam turbine is no less than the first threshold value and no more than a second threshold value; and adjusts the aperture of said second valve according to the load of said steam turbine with said first valve fully opened, in a case where the load of said steam turbine is no less than the second threshold value.

* * * * *